United States Patent [19]

Dickison et al.

[11] Patent Number: 4,615,844

[45] Date of Patent: Oct. 7, 1986

[54] WATER DISTRIBUTION SYSTEM

[75] Inventors: Maxwell Dickison; Anthony D. Kearney, both of St. Marys, Australia

[73] Assignee: F. F. Seeley Nominees Pty. Ltd., St. Marys, Australia

[21] Appl. No.: 746,392

[22] Filed: Jun. 19, 1985

[30] Foreign Application Priority Data

Jun. 26, 1984 [AU] Australia ..... PG5691

[51] Int. Cl.[4] ..... B01F 3/04

[52] U.S. Cl. ..... 261/29; 415/53 R

[58] Field of Search ..... 261/29; 415/53 R

[56] References Cited

U.S. PATENT DOCUMENTS

| | | | |
|---|---|---|---|
| 1,614,647 | 1/1927 | Brooks | 261/29 |
| 2,209,999 | 8/1940 | Patch | 261/DIG. 44 |
| 2,627,817 | 2/1953 | Mann et al. | 415/53 |
| 2,631,021 | 3/1953 | Arnold | 261/29 |
| 3,171,401 | 3/1965 | McDuffee | 261/DIG. 44 |
| 4,290,979 | 9/1981 | Sugiura | 261/4 |
| 4,338,264 | 7/1982 | Seeley | 261/29 |

FOREIGN PATENT DOCUMENTS

| | | | |
|---|---|---|---|
| 1135191 | 4/1957 | France | 415/53 R |
| 8102221 | 12/1982 | Netherlands | 415/53 R |

*Primary Examiner*—Tim Miles

*Attorney, Agent, or Firm*—Baker, Maxham & Jester

[57] ABSTRACT

Evaporative coolers, in the past, have used blowers or fans with horizontal axes of rotation, and pumps with vertical axes of rotation, since the pumps were immersed in base tanks and were thereby always primed. Consequently there has been a need for two separate motors, or alternatively, for drive means between the fan motor and the pump drive shaft. This invention relates to a water distribution means which primes a pump, even though it is above the base tank, by providing a suction conduit with an upwardly directed elbow between the pump and the base tank which will drain when the pump stops, but the spreader above the pump contains a well which slowly empties into the pump housing and conduit, the elbow inhibiting any further syphoning of the water from the pump housing into the base tank. Accordingly, the pump may be coupled to the fan for coaxial rotation therewith.

7 Claims, 3 Drawing Figures

WATER DISTRIBUTION SYSTEM

This invention relates to a system for water distribution within an evaporative cooler of the type which utilises a pump to pump water over an absorbent pad, and a fan to move air through that pad, thereby evaporating some of the water and reducing sensible heat.

BACKGROUND OF THE INVENTION

In most coolers, there is a requirement for a fan shaft to be horizontal. In the past, pump shafts have usually been vertical, and the pumps located within base tanks (see for example, U.S. Pat. No. 4,338,264). However there is a considerable saving to be effected if the pump shaft is coaxial with an horizontal fan shaft, but to achieve this, the pump must be below the water spreader but above the water level of the base tank.

One of the problems which is encountered with water distribution systems used heretofore is that, in the event of a tank running dry, unless a pump is of the small clearance (and sometimes unsatisfactory) self-priming type, it needs repriming. However, the pump is preferably of the large clearance centrifugal type, and if not reprimed will form an annulus of water within the housing and a central core of air, and this will prevent operation. Repriming as previously known is tedious and is an undesirable operation, particularly as sometimes it needs to be undertaken by people who are not mechanically skilled.

The main object of this invention is to provide improvements whereby a pump will be reprimed with water when not in use, so that once it is primed it is likely to remain primed, thereby enabling the pump to be coaxial with the fan (or blower) shaft.

BRIEF SUMMARY OF THE INVENTION

In order to arrange a pump to be coaxial with a fan or blower shaft, the water distribution means of this invention is arranged to prime a pump even though it is located below a spreader and above the base tank of a cooler by providing an upwardly directed elbow in a suction conduit extending downwardly from the pump to the base tank which will quickly drain when the pump stops, but the spreader above the pump contains a well which slowly empties into the pump housing and conduit, the elbow inhibiting further syphoning of the water from the pump housing into the base tank because of entrapped air therein.

More specifically in this invention water distribution means comprises a pump located at a lower level than a water containing but at a higher level than a base tank, and is arranged to lift water from the base tank, discharge it into the water container and thence over an evaporator element and back into the base tank, comprising a suction conduit which extends downwardly from the pump to the base tank, the shape of said suction conduit however including an upwardly directed portion located above the pump, and a discharge conduit which extends upwardly from the pump through a wall of the container and into the container, a water flow path between the container and the discharge conduit and having an opening into the container, the dimensions of the conduits and opening being such that, when the pump is stationary, water in the conduits will initially drain into the base tank but, after such draining, water flowing from the container through the opening will recharge the conduits and pump sufficiently to prime the pump but syphon action will be inhibited by air entrapped in the upwardly directed portion.

BRIEF DESCRIPTION OF THE DRAWINGS

An embodiment of the invention is described hereunder in some detail with reference to and as illustrated in the accompanying drawings in which.

Figure 1:
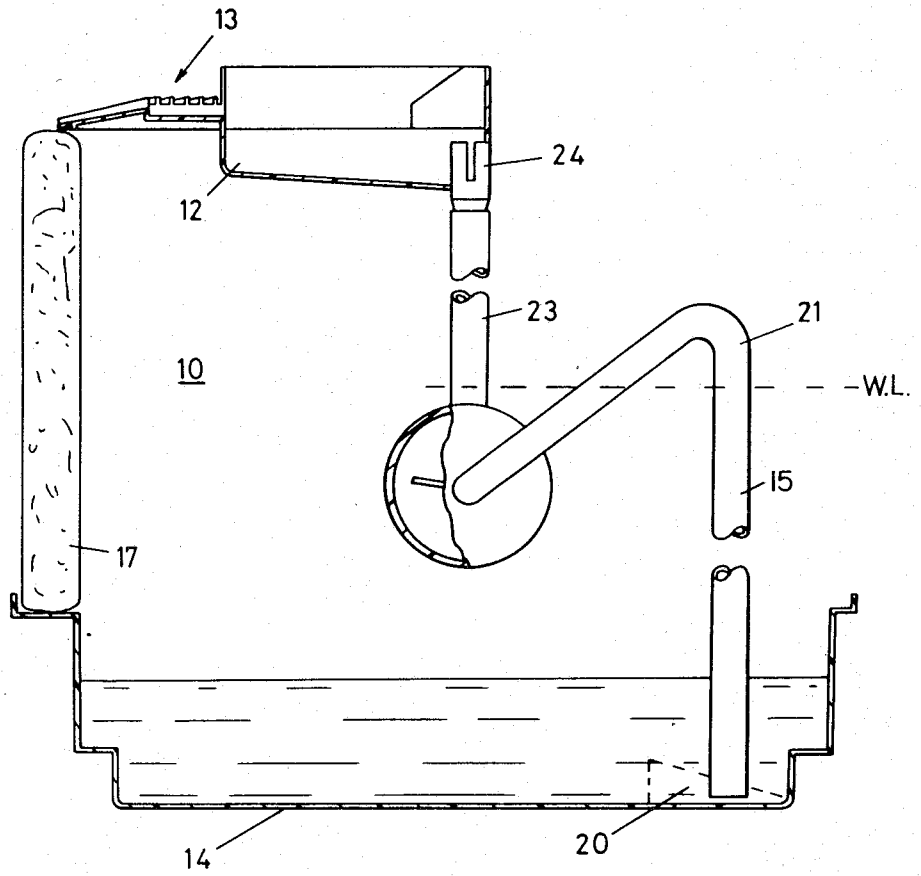
FIG. 1 is a diagrammatic representation showing a pump, a spreader containing a well, and a base tank.
Figure 2:
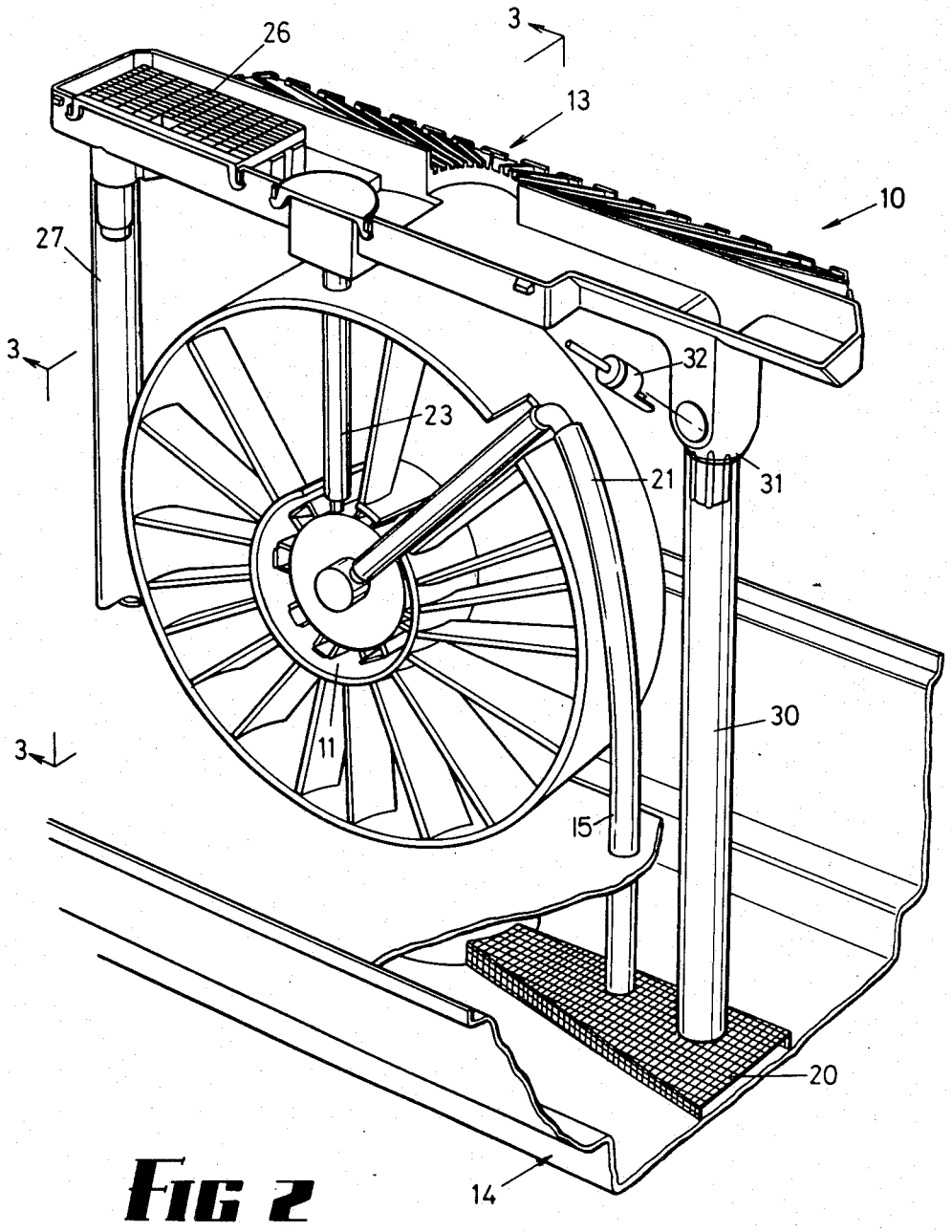
FIG. 2 is a fragmentary perspective view showing the arrangement of a pump, spreader, and base tank.
Figure 3:
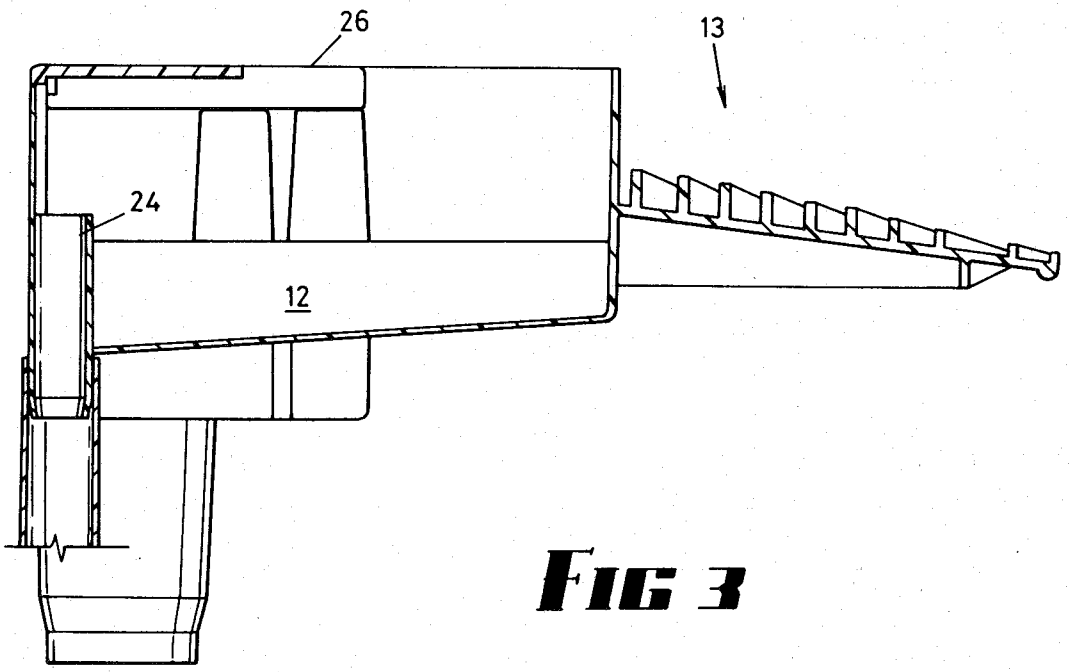
FIG. 3 is a section taken on plane 3—3—3 of FIG. 2.

In this embodiment, a water distribution means for an evaporative cooler 10 comprises a pump 11 located at a lower level than a water container which is in the form of a well 12 in spreader 13, and at a higher lever than a base tank 14 which forms the base of a cooler 10.

The pump 11 is arranged to lift the water through a suction conduit 15 from the base tank 14, discharge it into the well 12 from which it flows over the spreader 13, downwardly over an evaporator element, being a woodwool pad 17, and back into the tank 14.

The suction conduit 15 extends upwardly from a space in the base tank 14 below a filter 20 (so that it receives only filtered water), past an elbow 21 and then downwardly to the suction side of the pump 11. Elbow 21 is therefore an upwardly directed elbow which functions to break the syphon as described hereunder.

The discharge conduit 23 from the pump 11 extends upwardly part way into the well 12, but has an elongate slot 24 which forms a water flow opening from the well 12 back into the discharge conduit 23, the housing of pump 11 and the suction conduit 15. There is also provided in the spreader 13 a filler opening (not shown) above a grid 26 which is so arranged that, when filling the base tank 14, most of the water descends through a filler tube 27, but necessarily some of the water flows into the well 12 and thereby fills the discharge conduit 23 and the housing of pump 11 flowing outwardly therefrom, up over the upwardly directed elbow 21 and downwardly through the suction conduit 16. However, air which exists in the upwardly directed elbow 21 will break any syphon which might otherwise exist so that the water level will remain approximately at the location marked WL on FIG. 1.

An identical condition exists when the pump has been operating and comes to a stop, in that the water contained in conduits 15 and 23 and pump housing 11 will drain back into base tank 14 entrapping some air in the upper end of downwardly directed elbow 21. However, water which lies within well 12 below the top of the discharge conduit 23 will only slowly flow downwardly from slot 24 and thereby reprime pump 11, rising as above into the upwardly directed elbow 21.

There are occasions when it is required to use the fan only of an evaporative cooler without discharging the water over the woodwool pad 17, and in order to make this possible, there is provided a drain tube 30 which extends back into the base tank 14 from the spreader 13, but terminating this drain tube 30 is a valve 31 containing a valve member 32 which can be rotated to allow such drain flow of water back into the base tank or inhibit such flow. When the flow is inhibited, the water then discharges over the pad 17, but when the valve is open, water, although continuously pumped from base tank 14, is discharged through drain tube 30 back into that tank.

We claim:

1. Water distribution means for an evaporative cooler, wherein a pump is located at a lower level than a water container but at a higher level than a base tank, and is arranged to lift water from the base tank, discharge it into the water container and thence over an evaporator element and back into the base tank, comprising a suction conduit which extends downwardly from the pump to the base tank, the shape of said suction conduit however including an upwardly directed portion located above the pump, and a discharge conduit which extends upwardly from the pump through a wall of the container and into the container, a water flow path between the container and the discharge conduit and having an opening into the container constructed so as to cause water to drain only slowly back into said conduit as said container empties after pump shut-off, the dimensions of the conduits and opening being such that, when the pump is stationary, water in the conduits will initially drain into the base tank but, after such draining, water flowing from the container through the opening will recharge the conduits and pump sufficiently to prime the pump but siphon action will be inhibited by air entrapped in the upwardly directed portion.

2. Water distribution means according to claim 1 wherein said upwardly directed portion of the suction conduit is an upwardly directed elbow.

3. Water distribution means according to either claim 1 or claim 2 further comprising a filter within said base tank, and the suction conduit opens into a space containing water which has flowed through the filter.

4. Water distribution means according to claim 1 further comprising a water spreader arranged to spread water discharged by the discharge conduit, said evaporator element being a pad of absorbent material beneath the water spreader.

5. Water distribution means according to claim 4 wherein said container comprises a well within the water spreader.

6. Water distribution means according to claim 5 wherein said discharge conduit extends upwardly through the base of the water spreader and opens into the well, said opening being a vertically extending slot in that portion of the discharge conduit which is within the well.

7. Water distribution means according to claim 4 further comprising a drain tube depending from the water spreader towards the base tank, and a valve in the path of flow of water when passing through the drain tube.

* * * * *